United States Patent [19]
Anisimov et al.
[11] 4,305,908
[45] Dec. 15, 1981

[54] GAS GENERATOR

[76] Inventors: Veniamin M. Anisimov, ulitsa Dekabristov, 15-6, Biisk Altaiskogo kraya; Valentin V. Belov, Klenovy bulvar, 8, kv. 47, Moscow; Vsevolod I. Verkevich, ulitsa Moldagulovoi, 18, korpus 2, kv. 254, Moscow; Mikhail M. Maiorov, 9 Parkovaya ulitsa, 6, korpus 1, kv. 232, Moscow; Nikolai A. Makarovets, ulitsa Radischeva, 2/2, kv. 18, Biisk Altaiskogo kraya; Nikolai N. Oreshkin, ulitsa Dekabristov, 2, kv. 39, Biisk Altaiskogo kraya; Jury E. Orionov, ulitsa Dekabristov, 12, kv. 13, Biisk Altaiskogo kraya, all of U.S.S.R.

[21] Appl. No.: 168,415

[22] Filed: Jul. 10, 1980

[30] Foreign Application Priority Data

Jul. 11, 1979 [SU] U.S.S.R. ..... 2781052

[51] Int. Cl.[3] ..... B01J 7/00
[52] U.S. Cl. ..... 422/164; 422/165; 422/167; 60/39.47

[58] Field of Search ..... 422/120, 126, 165, 166, 422/167, 164; 60/39.47; 280/736, 741; 102/39 R

[56] References Cited

U.S. PATENT DOCUMENTS 3,558,285 1/1971 Ciccone et al. ..... 422/165

*Primary Examiner*—William F. Smith
*Attorney, Agent, or Firm*—McAulay, Fields, Fisher, Goldstein & Nissen

[57] ABSTRACT

A gas generator comprises a housing accommodating a combustion chamber with a hollow solid-reactant charge, and a cooling chamber with a solid sublimating coolant, separated by a partition with an axial passage, and a sleeve with a perforated side surface. The gas generator is also provided with guides secured in the axial passage of the partition. The sleeve having a collar on the side of the open portion is disposed in the guides and adapted to move along the longitudinal axis of the gas generator. The present invention makes it possible to improve the operational reliability of power drives and offers a most simple solution to a number of problems associated with inflation of inflatable life-saving appliances, lifting of loads from under water, starting of engines.

4 Claims, 2 Drawing Figures

GAS GENERATOR

TECHNICAL FIELD

The invention relates to the technique of constructing devices for obtaining high-pressure products of combustion and more particularly to gas generators.

According to the present invention the gas generator may be most advantageously used for actuation of different power drives, filling of elastic shells with gas, lifting of loads from under water, inflation of inflatable life-saving appliances and for starting of engines.

BACKGROUND ART

Known to the prior art is a low-temperature solid-reactant gas generator (FRG Pat. No. 2,252,741 Cl. CO5D5/00, 1976). The gas generator comprises a housing accommodating a combustion chamber with a hollow solid-reactant charge and a cooling chamber with a solid coolant, separated by a partition with a passage. A perforated sleeve or a movable element (worm) is installed in the cooling chamber of the gas generator.

Construction of the gas generator fails to exclude leakage of hot gases from the perforated sleeve to the outlet pipe connection due to which the amount of a decomposed coolant is reduced and, consequently, the effectiveness of the gas generator is lowered. The provision of a movable element in the form of a worm in the cooling chamber complicates the construction and technology of manufacture and charging of the gas generator, encumbers the cooling chamber and causes an increase in the overall dimensions of the gas generator and, consequently, reduces the weight figure of merit.

Also known in the prior art is a solid-reactant gas generator (U.S. Pat. No. 3,558,285 Cl. 23-281, 1969), comprising a housing accommodating a combustion chamber with a hollow solid-reactant charge, and a cooling chamber with a sublimating solid coolant, separated by a partition with an axial passage. At least one sleeve with a perforated side surface is fixedly disposed in the cooling chamber between the partition and the housing end plate, coaxially with the hole in the partition.

Perforations of the sleeve are made in the form of holes with the diameter thereof diminishing throughout the sleeve length. However, due to such an arrangement of the sleeve and its perforations, a hot gas may pass to the outlet preferably through the holes nearest to the outlet where the coolant resistance is lower. This lowers the effectiveness of the gas generator and reduces its weight figure of merit. The provision of sleeve perforations in the form of holes, variable in cross-section complicates, the technology of manufacture of the gas generator, and the arrangement of the sleeve in the cooling chamber complicates the charging of the gas generator.

SUMMARY OF THE INVENTION

It is an object of the present invention to provide a gas generator possessing an improved effectiveness of operation and an increased weight figure of merit.

It is another object of the present invention to provide a gas generator having a simplified construction and technology of its manufacture and charging.

These and other objects of the invention are accomplished by the provision of a gas generator comprising a housing accommodating a combustion chamber with a hollow solid-reactant charge, and a cooling chamber with a solid sublimating coolant, separated by a partition with an axial passage, and with at least one sleeve having a perforated side surface, and according to the invention, secured in the axial passage of the partition are guides projecting into a passage of the hollow solid-reactant charge. Also in the gas generator, according to the invention, the sleeve with the perforated side surface is disposed in the guides and adapted to move along the longitudinal axis of the gas generator, and a collar is made on the surface of the sleeve open portion positioned in the passage of the hollow solid-reactant charge.

It is advantageous that in a sleeve disposed in the guides and adapted to move along the longitudinal axis of the gas generator, the perforations should be made tangentially in relation to the internal surface of the sleeve.

The present invention provides a substantial improvement in the operational reliability of power drives and offers a most simple solution to a number of problems associated with inflation of inflatable life-saving appliances, starting of engines and lifting of loads from under water.

BRIEF DESCRIPTION OF THE DRAWINGS

The invention will now be described in detail with reference to the accompanying drawings illustrating a specific embodiment thereof, in which.

DETAILED DESCRIPTION OF THE INVENTION

Figure 1:
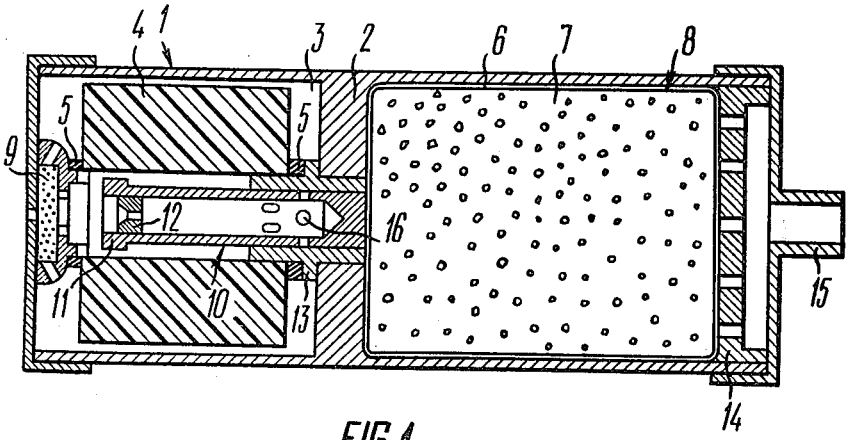
FIG. 1 illustrates a construction diagram of a gas generator with one sleeve having a perforated side surface, according to the invention.

The gas generator comprises a housing 1 (FIG. 1) with a partition 2, a combustion chamber 3 with a hollow solid-reactant charge 4 secured through the medium of shock absorbers 5, and a cooling chamber 6 with a solid sublimating coolant 7 in a package 8.

The gas generator also comprises a combustion initiator 9, a movable sleeve 10 with a perforated side surface, and a collar 11 being made on the surface of the sleeve 10 from the side of its open portion disposed in a passage of the hollow solid-reactant charge 4.

The sleeve 10 is also provided with a throttle 12. Guides 13 are secured in an axial passage of the partition 2 and project into the passage of the hollow solid-reactant charge 4. The sleeve 10 disposed in the guides 13 is adapted to move along the longitudinal axis of the gas generator.

The gas generator also incorporates a grid 14 and an outlet pipe connection 15.

The sleeve 10 is provided with perforations 16 for out flow of hot gases, made in the form of holes in one row or in a plurality of rows near an end plate of the sleeve 10. The holes are made radially or tangentially in relation to the internal surface of the sleeve 10.

If the perforations 16 are made tangentially, the sleeve 10 while moving axially will be rotated by reactive forces produced by the outflowing gas jets. This improves the interaction of the hot gas with the coolant 7 and steps up the effectiveness of the gas generator.

The disposition of the sleeve 10 in the combustion chamber 3 makes it possible to obviate clogging of the passage areas with particles of the coolant 7 and also permits the coolant 7 to be used as a single element enclosed in the package 8, thereby improving the reliability of the gas generator.

Figure 2:
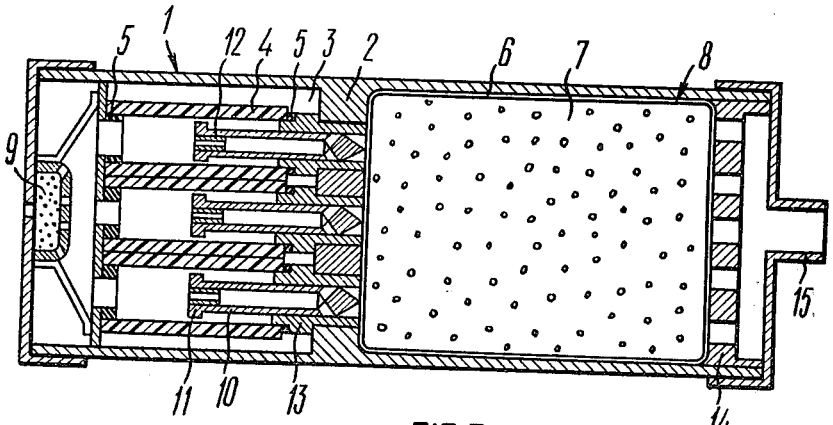
FIG. 2 illustrates a construction diagram of a gas generator with a plurality of sleeves having perforated side surfaces and pointed end plates according to the invention.

Referring now to FIG. 2, there is shown a gas generator provided with a plurality of the guides 13 accommodating the movable sleeves 10 with the collars 11 and throttles 12, while the hollow solid-reactant charge 4 has the number of passages corresponding to the number of the installed sleeves 10 with the perforated side surface. The sleeves 10 are made with pointed end plates.

The use of the sleeves 10 with the pointed end plates is expeditious at short-time operation of the gas generator and great mass flow of the gas. Large-size gas generators are provided with a plurality of the coaxial sleeves 10 having the perforated side surface.

In case the sleeve 10 is provided with a flat end plate, the time period during which the sleeve is moving, may be prolonged till the moment the gas generator ceases to operate and throughout the entire period of this time the coolant 7 is reliably compacted and leakage of hot gases is prevented.

The provision of the guides 13 ensures a reliable motion of the sleeve 10 into the cooling chamber 6 without cocking or jamming.

The gas generator operates in the following way.

As the combustion initiator 9 (FIG. 1) operates, the hollow solid-reactant charge 4 contained in the combustion chamber 3 of the housing 1, is ignited. As a result, the pressure of hot gases (products of combustion) in the combustion chamber 3 rises and the sleeve 10 acted upon by this pressure moves along the guides 13 installed in the partition 2, into the cooling chamber 6 until the collar 11 thrusts against the guides 13. As this takes place, the coolant 7 is compacted and the package 8 is ruptured. As the sleeve 10 moves, the hot gas passing through the perforations 16 enters the coolant 7 in a radial direction and interacts with the latter. The flow of gas in the radial direction combined with a simultaneous motion of the sleeve 10 and compaction of the coolant 7, provides the most complete utilization of the coolant 7, i.e. improves the effectiveness of the gas generator. From the cooling chamber 6, the hot gas passes through the grid 14 into the outlet pipe connection 15. The combustion conditions of the hollow solid-reactant charge 4 are maintained due to the provision of the throttle 12 installed in the sleeve 10. In transportation of the gas generator, security of the hollow solid-reactant charge 4 is ensured by the shock absorbers 5 and that of the coolant 7, by the provision of the package 8.

The fact that the cooling chamber 6 is free from constructional elements makes it possible to use the packaged coolant 7, which simplifies the charging procedure and cuts down the consumption of metal for manufacture of the gas generator. This, together with the high effectiveness of the gas generator, provides a high weight figure of merit.

Thus, the present invention makes it possible to step up the effectiveness of the gas generator and increase the weight figure of merit, to simplify the construction and technology of manufacture and charging of the gas generator.

What is claimed is:

1. A gas generator comprising:

a housing;

a combustion chamber disposed in said housing;

a hollow solid-reactant charge disposed in said combustion chamber, and a passage in said hollow solid-reactant charge;

a cooling chamber disposed in said housing;

a solid sublimating coolant disposed in said cooling chamber;

a partition separating said combustion chamber from said cooling chamber, and an axial passage in said partition;

at least one guide secured in said axial passage of said partition and projecting into said passage of said hollow solid-reactant charge;

at least one sleeve with a perforated side surface, disposed in said guides and adapted to move along the longitudinal axis of said gas generator, an open portion of said at least one sleeve with the perforated side surface, disposed in said passage of said hollow solid-reactant charge, and an internal surface of said at least one sleeve with the perforated side surface; and a collar surrounding said open portion of said at least one sleeve with the perforated side surface.

2. A gas generator according to claim 1, comprising:

the perforations in the at least one said sleeve with the perforated side surface made tangentially in relation to said internal surface of said at least one sleeve with the perforated side surface.

3. The gas generator according to claim 1, wherein said perforated side surface includes radial holes in at least one row relative to said internal surface.

4. The gas generator according to claim 2, 1 or 3 including at least two of said guides, each of said guides having therein one of said sleeves with the perforated side surface; and each of said sleeves including pointed end plates.

* * * * *